US010079440B1

(12) United States Patent
Didonato et al.

(10) Patent No.: US 10,079,440 B1
(45) Date of Patent: Sep. 18, 2018

(54) ELECTRICAL TERMINAL HAVING A PUSH SURFACE

(71) Applicant: TE CONNECTIVITY CORPORATION, Berwyn, PA (US)

(72) Inventors: Michael Edward Didonato, Harrisburg, PA (US); David Tracy Humphrey, Red Lion, PA (US); Raymond L. Landon, III, Elizabethtown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/587,600

(22) Filed: May 5, 2017

(51) Int. Cl.
*H01R 4/48* (2006.01)
*H01R 4/18* (2006.01)

(52) U.S. Cl.
CPC ..... *H01R 4/48* (2013.01); *H01R 4/185* (2013.01)

(58) Field of Classification Search
CPC ..... H01R 4/48; H01R 4/185; H01R 13/04; H01R 13/05; H01R 13/187
USPC ..... 439/867, 850, 845, 849
See application file for complete search history.

(56) References Cited

U.S. PATENT DOCUMENTS 3,555,493 A * 1/1971 Baumanis ..... H01R 12/721 439/636
4,348,070 A * 9/1982 Simon ..... H01R 13/501 439/586
4,391,485 A 7/1983 Urani
6,837,745 B2 * 1/2005 Takada ..... H01R 13/562 439/521
7,198,526 B1 * 4/2007 MacNeil ..... H01R 4/185 439/881
7,591,694 B2 * 9/2009 Osada ..... H01R 4/185 439/852
8,057,261 B1 * 11/2011 DeSio ..... H01R 13/506 439/625
9,009,962 B2 * 4/2015 Sugie ..... H01R 13/03 29/870
9,692,163 B1 * 6/2017 Didonato ..... H01R 4/70
2002/0142663 A1 10/2002 Takeyama et al.
2013/0052889 A1 2/2013 Shen

OTHER PUBLICATIONS

International Search Report and Written Opinion issued for PCT/I132018/052631 dated Jun. 12, 2018.

* cited by examiner

*Primary Examiner* — Tulsidas C Patel
*Assistant Examiner* — Travis Chambers

(57) ABSTRACT

An electrical terminal having a contact portion, a wire termination portion and a transition portion. The contact portion is configured to receive a mating terminal along a mating axis. The wire termination portion defines a wire termination axis that intersects the mating axis. The transition portion extends between the contact portion and the wire termination portion. The transition portion extends parallel to the mating axis and the wire termination axis. An engagement section extends at an angle from the transition portion. The engagement section has a push surface intersecting the mating axis. Wherein a force can be applied to the push surface to mate the contact portion with the mating terminal.

8 Claims, 3 Drawing Sheets

ELECTRICAL TERMINAL HAVING A PUSH SURFACE

FIELD OF THE INVENTION

The present invention is directed to an electrical terminal with an enhanced bearing surface. In particular, the invention is directed to a terminal with a push surface which facilitates the mating or insertion of the terminal onto a mating connector or into a connector housing.

BACKGROUND OF THE INVENTION

Quick-connect terminal connectors are female terminals that mate with male tab terminals, tab adapters and tab terminal blocks. They are used where quick attachment and removability are desired. Flag terminals have the quick attachment at a right angle to the electrical wire to which the connector is attached. They are available as fully insulated, non-insulated or partially insulated. They are available with open or closed barrel crimps.

One reason for the existence of flag terminals is for space saving because a right angle terminal can generally fit into smaller spaces than straight terminals. The quick connect portion of flag terminals of the prior art extend at a right angle away from the axis of the wire in an L shape.

While flag terminals are beneficial in various applications, the insertion of the flag terminals into housings or the mating of the flag terminals with mating terminals can be difficult. The bearing surface on known flat terminals is small and difficult to access and may have sharp edges, making it difficult to insert the terminals into the connector housing or mate with the mating terminals. This can cause injuries to the assemblers of the terminals and damage to the terminals and connectors if the insertion of the terminal position assurance device or of the connector housing is not done properly. Alternatively, machinery or tooling may be used to facilitate the assembly or mating of the terminals.

A need remains for a terminal, in particular a flag terminal, which can be easily and effectively inserted into the connector housing or mated with a mating terminal. In particular, it would be beneficial to provide a device with an ergonomically friendly bearing surface which allows for ease of insertion of the terminal in a connector housing and/or which allows for the ease of mating the terminal with a mating terminal.

SUMMARY OF THE INVENTION

An object of the invention is to provide a terminal which can be easily and effectively mated to a mating terminal without the need for special tooling and/or without injury to the assembler.

An object of the invention is to provide a terminal which can be easily and effectively inserted into a connector housing without the need for special tooling and/or without injury to the assembler.

An object of the invention is to provide a terminal with an ergonomically friendly bearing surface which allows for ease of mating or insertion.

An embodiment is directed to an electrical terminal having a contact portion, a wire termination portion and a transition portion. The contact portion is configured to receive a mating terminal along a mating axis. The wire termination portion defines a wire termination axis that intersects the mating axis. The transition portion extends between the contact portion and the wire termination portion. The transition portion extends parallel to the mating axis and the wire termination axis. An engagement section extends at an angle from the transition portion. The engagement section has a push surface intersecting the mating axis. Wherein a force can be applied to the push surface to mate the contact portion with the mating terminal.

An embodiment is directed to an electrical terminal having a push surface. The terminal includes a contact portion, a wire terminating portion and a transition portion. The contact portion is configured to receive a mating terminal along a mating axis. The wire termination portion defines a wire termination axis that intersects the mating axis. A transition portion extends between the contact portion and the wire terminating portion. The transition portion has an engagement section with the push surface provided thereon. The push surface intersects the mating axis. The push surface of the engagement section is configured to allow a force to be applied to the engagement section to mate the contact portion of the terminal to a mating electrical terminal.

An embodiment is directed to a terminal having a push surface. The terminal includes a contact portion, a wire terminating portion and a transition portion. The contact portion is configured to receive a mating terminal along a mating axis. The wire termination portion defines a wire termination axis that intersects the mating axis. A transition portion extends between the contact portion and the wire terminating portion. The transition portion has an engagement section with the push surface provided thereon. The push surface intersects the mating axis. The push surface of the engagement section has a surface height which is greater than an edge height of a main portion of the transition portion. A surface area of the push surface is larger than a surface area of an exposed edge of the main portion of the transition portion. The push surface of the engagement section is configured to allow a force to be applied to the engagement section to mate the contact portion of the terminal to a mating electrical terminal.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
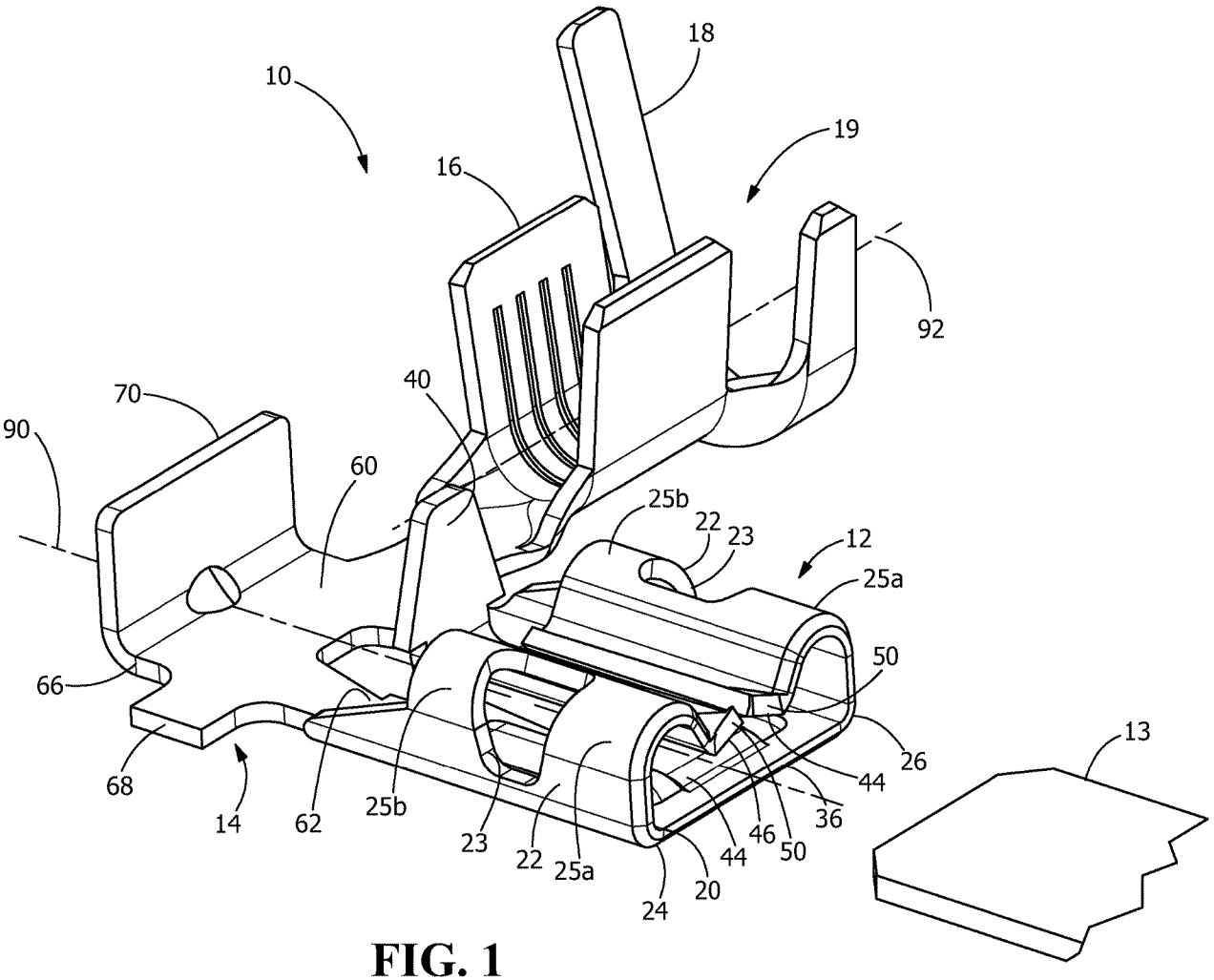
FIG. 1 is a top, front perspective view of an illustrative embodiment of the terminal according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom"

as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As best shown in FIGS. 1 through 4, a receptacle, socket or female electrical terminal 10 includes a contact portion 12, a transition portion 14, a wire barrel 16 and an insulation barrel 18. The wire barrel 16 is configured for crimped connection with an end of a conductive core of an insulated wire. The insulation barrel 18 is configured for crimped connection with an end of the insulation coating or jacket of the wire. The wire barrel 16 and the insulation barrel 18 are part of a wire termination portion 19. Although the wire barrel 16 and the insulation barrel 18 are shown, other types of termination portions may be used without departing from the scope of the invention. In addition, although illustrative contact portion 12 is shown, other types of contact portions may be used without departing from the scope of the invention. In the illustrative embodiment shown, the terminal 10 is stamped and formed from a metal plate having a good electrical conductivity.

Figure 2:
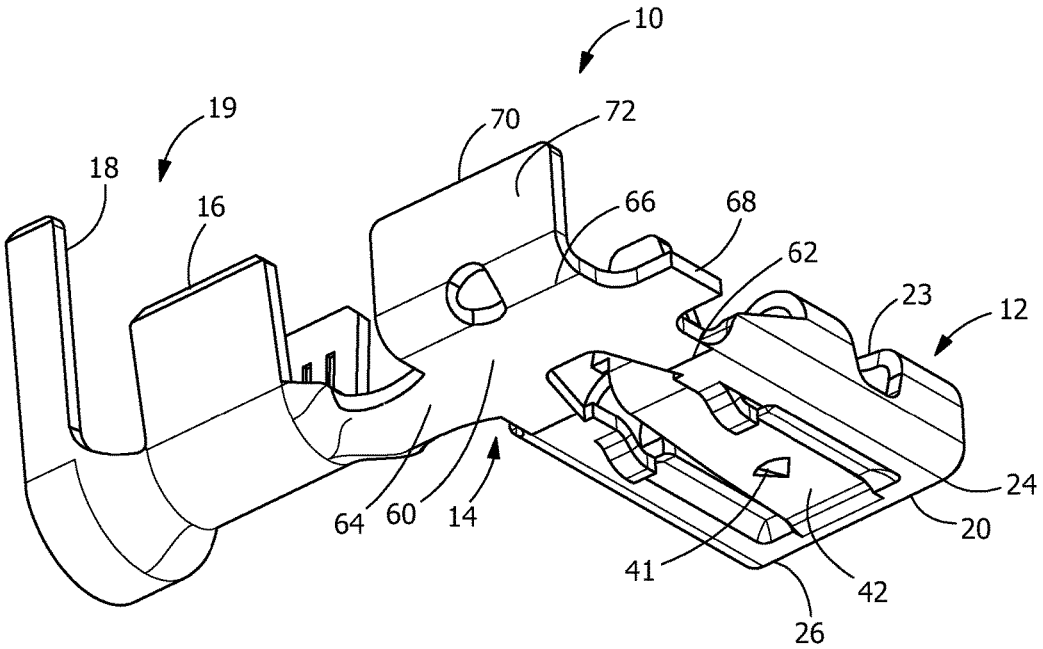
FIG. 2 is a bottom rear perspective view of the terminal of FIG. 1.
Figure 3:
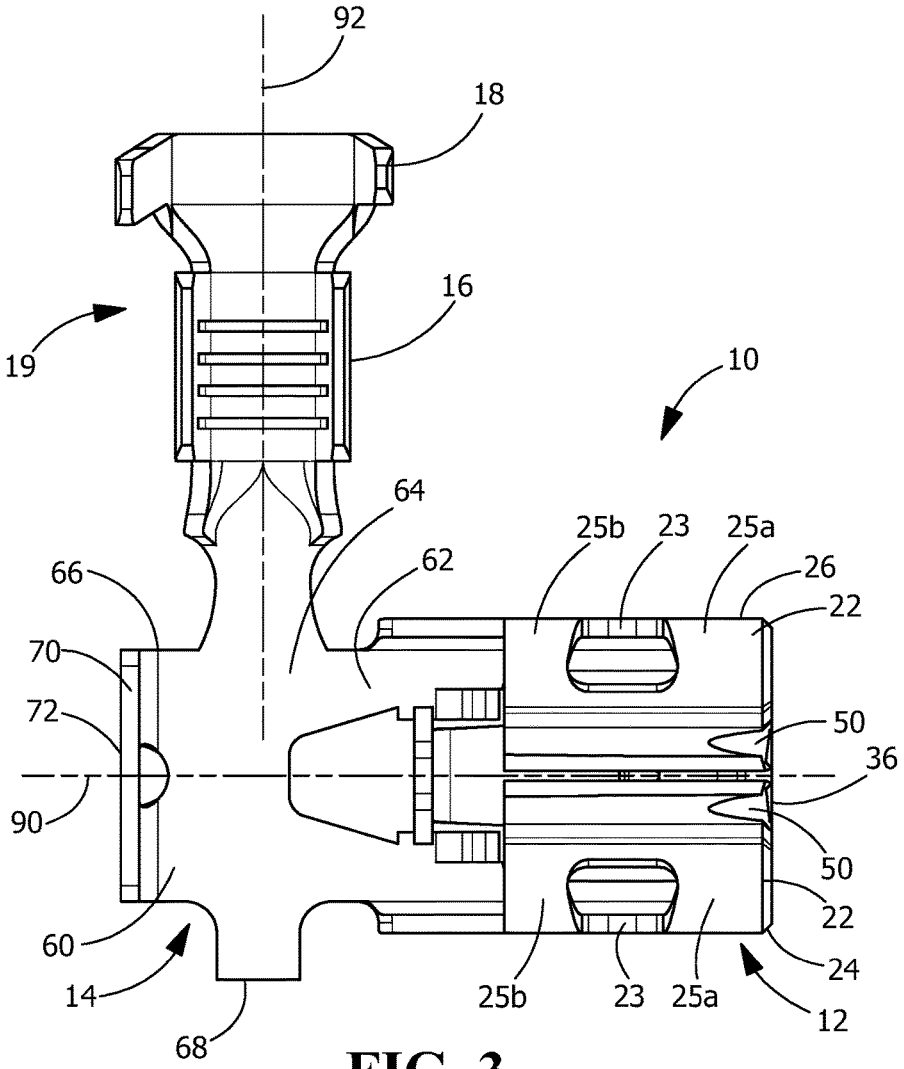
FIG. 3 is a top view of the terminal of FIG. 1.

The contact portions 12 is configured to receive a mating terminal 13 of a mating electrical connector or device. The illustrative contact portion 12 includes a bottom wall 20 and resilient contact arms 22 which extend from either side 24, 26 of the bottom wall 20. As best shown in FIG. 2, the bottom wall 20 has a spring arm 42 provided thereon. The spring arm 42 is stamped and formed from the bottom wall 20. The illustrative contact portion 12 is shown and described in co-pending U.S. patent application Ser. No. 15/203,024, which is hereby incorporated by reference in its entirety.

The spring arm 42 extends from the bottom wall 20 to create a raised portion or end wall 40 extending from the inner surface of the bottom wall 20 toward the resilient arms 22. The spring arm 42 may include a projection or embossment, such as, but not limited to, a detent, dimple or lance 41 which is formed from the spring arm 42 to create a raised area on an inner surface of the spring arm 42. The lance 41 engages the mating terminal 13 as the mating terminal 13 is inserted into the mating portion 12.

In the illustrative embodiment shown, each resilient arm 22 has an opening or cutout 23 with a first resilient contact section 25*a* and a second resilient contact section 25*b* extending on either side of the opening 23. The first resilient contact section 25*a* is positioned proximate a mating end 36 of the contact portion 12. The second resilient contact section 25*b* is remote from the mating end 36 and located near the end wall 40 of the spring arm 42. The openings 23 extend between and separate the resilient contact sections 25*a*, 25*b*.

The resilient contact sections 25*a*, 25*b* have arcuate or curled portions which extend from the bottom wall 20 to a mating terminal engagement member 50. The configuration of each respective contact section 25*a*, 25*b* of the resilient contact arms 22 allows the stiffness and spring rate of each respective resilient contact section 25*a*, 25*b* and the resilient contact arms 22 to be controlled. Consequently, the respective resilient contact sections 25*a*, 25*b* may each be configured to generate a different contact force, resulting in different contact forces for the resilient contact arms 22.

The mating terminal engagement members 50 of the resilient contact arms 22 extend from the resilient contact sections 25*a*, 25*b* and span opening 23. In the illustrative embodiment shown, the mating terminal engagement members 50 are asymmetrical, having lead-in surfaces 44 positioned proximate the mating end 36. The lead-in surfaces 44 are provided to prevent stubbing of the mating terminal 13 on the edge of the resilient arms 22 and to help guide the mating terminal 13 into a mating slot 46 of the contact portion 12 and to reduce the insertion force required to insert the mating terminal 13 into the slot 46. The configuration of the resilient contact arms 22 provide the resiliency needed to allow the mating terminal engagement member 50 to move relative to the bottom wall 20 as the mating terminal 13 is inserted into the slot 46.

In the illustrative embodiment shown, the spring arm 42 is stamped and formed from the bottom wall 20. The spring arm 42 is formed to allow a free end thereof to move or be resiliently deformed relative to the bottom wall 20, allowing the spring arm 42 and the lance 41 to move toward and away from the mating terminal engagement member 50.

In the illustrative embodiment shown, the spring arm 42 has an end wall 40 provided thereon. The end wall 40 extends from the spring arm 42 to create a stop portion which extends from the inner surface of the spring arm 42 toward the mating terminal engagement member 50. The end wall 40 is provided to limit the distance the mating terminal 13 can be inserted into the slot 46.

The configuration of the resilient contact arms 22 and the spring arm 42 allows the contact portion 12 to compensate for minor misalignment of the mating terminal 13 or minor warpage or imperfections associated with the mating terminal 13.

In a fully inserted position, the lance 41 of the spring arm 42 and the mating surfaces of the mating terminal engagement members 50 are all provided in electrical and mechanical contact with the mating terminal 13. The multiple areas of contact allow the receptacle terminal 10 to be used in applications in which higher current levels, such as, but not limited to, 15 amps to 20 amps or more. The configuration of the spring arm 42 and mating terminal engagement member 50 provides a stable and reliable electrical connection between the mating terminal 13 and the terminal 10. The configuration of the lance 41 of the spring arm 42 and the mating terminal engagement member 50 provide for higher Hertzian stresses, thereby eliminating or minimizing fretting corrosion between the terminal 10 and the mating terminal 13, thereby providing a stable and reliable electrical connection between the mating terminal 13 and the terminal 10.

The configuration of the resilient contact arms 22 and the spring arm 42 and the use of multiple contact areas allows for a lower normal force during mating and unmating of the mating terminal 13 from the receptacle terminal 10. This allows the mating terminal 13 and the receptacle terminal 10 to be more durable over numerous cycles, as there is less plating wear due to the lower mating or normal forces. The number of contact areas also allows the receptacle terminal 10 to be used at higher current levels, as the multiple contact areas allow the extreme heat associated with the high current levels to be dispersed, thereby preventing welding of the contact asperities.

The illustrative contact portion 12 shown in FIGS. 1 through 4 is just one example of the type of contact portion 12 that can be used with transition portion 14 of the present invention.

The transition portion 14 extends between the contact portion 12 and the wire barrel 16. In the illustrative embodiment shown, the contact portion 12 defines a mating axis 90 (FIGS. 1 and 3) along which the mating terminal is received. The wire barrel 16 and the insulation barrel 18 define a wire termination axis 92 that extends at an angle, preferably perpendicular, to the mating axis 90. The transition portion 14 has a main portion 60 with a first end 62 which is integrally attached to the contact portion 12, a second end 64 which is integrally attached to the wire barrel 16, a third end 66 which is opposite the first end 62 and a fourth end 68 which is opposite the second end 64.

The third end 66 has an engagement section 70 which extends therefrom. In the illustrative embodiment, the engagement section 70 extends at approximately 90 degrees (i.e., perpendicularly) to the main portion 60 of the transition portion 14, however, the engagement section 70 may extend at other angles other than 90 degrees. The engagement section 70 extends at least part of the length of the third end 66, extending from proximate the fourth end 68 toward the second end 64 and the wire barrel 16. As best shown in FIG. 1, the engagement section 70 is provided in approximate alignment with the contact portion 12. The engagement section 70 has an ergonomic bearing or push surface 72 that allows an assembler to push the engagement section 70 during assembly of the terminal 10 into a mating connector or the mating of the terminal 10 to the mating terminal 13, as will be more fully described.

Figure 4:
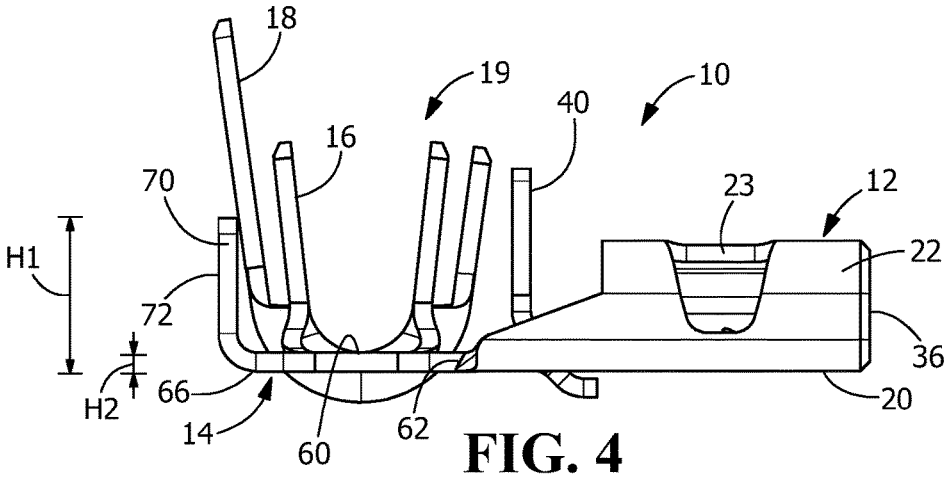
FIG. 4 is a side view of the terminal of FIG. 1.

As best shown in FIG. 4, the push surface 72 of the engagement section 70 has a height H1 which is greater than the height H2 of the main portion 60 of the transition portion 14. Consequently, the surface area of the push surface 72 is significantly larger than an exposed edge of the main portion 60 of the transition portion 14. Stated differently, the push surface 72 provides a surface area which is wider or higher than the height of the edge of the main portion 60 of the transition portion 14. This allows the assembler to use his thumb or finger to push the push surface 72 and consequently, the terminal 10 into proper position. This is in contrast to known flat terminals which have small surfaces and sharp edges, thereby causing difficulty for assemblers to properly mate or assemble the terminal to a mating connector or connector housing. By providing the engagement surface 72, the terminal is more ergonomically friendly. This helps to prevent damage or injury to the assembler's thumbs, fingers and wrists, thereby reducing the amount of injury claims brought by the assemblers. In addition, as the force applied by the assemblers is able to be more consistent, less mating or insertions errors occur, thereby providing a more cost effective method of mating or assembly.

In the illustrative embodiment shown, the push surface 72 and the engagement section 70 are in-line with the contact portions 12, such that the mating axis 90 intersects the push surface 72 and the engagement section 70. Preferably, the push surface 72 extends perpendicular to the mating axis. This allows a force applied to the push surface 72 and the engagement section 70 to be uniformly distributed over the entire transition portion 14 and contact portion 12, thereby minimizing the force required for insertion of the terminal 10 into the connector 16.

As described above, the assembler engages and pushes the push surface 72 of the engagement section 70 to mate the terminal 10 with the mating terminal 13 or to insert the terminal 10 into a connector housing. In the illustrative embodiment, the push surface 72 is dimensioned to allow the thumb of the assembler to engage and drive the engagement surface 72. The use of the thumb has been found to be an ergonomically friendly method of moving the terminal 10. In addition, as the push surface 72 is positioned away from the wire barrel 16 and the insulation barrel 18, the wires terminated to the wire barrels 16 and insulation barrels 18 do not significantly interfere with the assembler engaging the engagement surface 72.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical terminal comprising:

a contact portion configured to receive a mating terminal along a mating axis, the contact portion including a bottom wall and resilient contact arms which extend from either side of the bottom wall, each resilient contact arm having a first resilient contact section having an arcuate or curled portion which extends from the bottom wall to a mating terminal engagement member, the bottom wall having a spring arm formed from the bottom wall, the spring arm having an end wall extending from the spring arm toward the mating terminal engagement member;

a wire termination portion defining a wire termination axis that intersects the mating axis;

a transition portion extending between the contact portion and the wire termination portion, the transition portion extending parallel to the mating axis and the wire termination axis, an engagement section extending at an angle from the transition portion, the engagement section having a push surface intersecting the mating axis, the push surface of the engagement section has a surface height which is greater than an edge height of a main portion of the transition portion, wherein a surface area of the push surface is larger than a surface area of an exposed edge of the main portion of the transition portion, the push surface is configured to allow an assembler to engage and apply a force to the push surface, the push surface is configured to allow the force to be applied to the contact portion to mate the contact portion of the terminal to a mating electrical terminal.

2. The electrical terminal as recited in claim 1, wherein the push surface is positioned away from the wire termination portion, wherein wires terminated in the wire termination portion do not interfere with the assembler engaging the engagement surface.

3. The electrical terminal as recited in claim 1, wherein the wire termination section has a wire barrel and an insulation barrel.

4. The electrical terminal as recited in claim 1, wherein the engagement section extends at approximately 90 degrees to a main portion of the transition portion.

5. The electrical terminal as recited in claim 4, wherein the main portion has a first end which is integrally attached to the contact portion, a second end which is integrally attached to the wire termination portion, a third end which is opposite the first end and a fourth end which is opposite the second end.

6. The electrical terminal as recited in claim 5, wherein a longitudinal axis of the contact portion is at a right angle relative to a longitudinal axis of an insulated wire which is terminated in the wire terminating portion.

7. The electrical terminal as recited in claim 6, wherein the engagement section extends from the third end of the transition portion.

8. The electrical terminal as recited in claim 7, wherein the engagement section extends from proximate the fourth end toward the second end and the wire termination portion.

* * * * *